United States Patent [19]

Murata et al.

[11] Patent Number: 4,702,811

[45] Date of Patent: Oct. 27, 1987

[54] PLATING DEVICE FOR MINUTE PORTIONS OF CONNECTOR TERMINALS

[75] Inventors: Yasuto Murata; Junichi Tezuka, both of Kanagawa; Kenji Yamamoto, Tokyo, all of Japan

[73] Assignee: Electroplating Engineers of Japan, Limited, Tokyo, Japan

[21] Appl. No.: 924,653

[22] Filed: Oct. 29, 1986

[30] Foreign Application Priority Data

Nov. 11, 1985 [JP] Japan ..... 60-250949

[51] Int. Cl.[4] ..... C25D 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 3,751,343 | 8/1973 | Macula et al. | 204/224 R |
| 3,951,772 | 4/1976 | Bick et al. | 204/224 R |
| 4,452,684 | 6/1984 | Palnik | 204/206 |
| 4,595,464 | 6/1986 | Bacon et al. | 204/15 |

FOREIGN PATENT DOCUMENTS

| | | | |
|---|---|---|---|
| 58-224193 | 12/1958 | Japan | 203/206 |
| 61-147263 | 9/1986 | Japan | 204/206 |

*Primary Examiner*—T. M. Tufariello

*Attorney, Agent, or Firm*—Flynn, Thiel, Boutell & Tanis

[57] ABSTRACT

This invention relates to an electro-plating device which is suitable for plating minute portions on protruding tip ends of a connector terminal. This invention device uses a plating solution supplying member in the form of a thin box which is erected upon a plating solution supplying box and which has a thickness small enough to be inserted between opposing plating areas. The plating areas are a pair of protruding tip ends of the connector terminal which move in contact with or near the supplying member. The plating solution supplying member comprises a combination of a supporting member made of an insulating sheet having a vertical section substantially shaped like an inverted letter U and a plating solution retaining member of a net or porous sheet which is supported by the supporting member to drape over the outer surfaces thereof. The supporting member is bored with plural holes for supplying plating solution which are arranged discretely in the longitudinal direction at the positions corresponding to the plating areas or close thereto. The plating solution is constantly supplied to the plating solution retaining member via the plural holes to seep thereon. The plating areas are electro-plated at minute portions thereof by contacting with the plating solution which is seeped out of the retaining member.

11 Claims, 7 Drawing Figures

PLATING DEVICE FOR MINUTE PORTIONS OF CONNECTOR TERMINALS

This invention relates to a plating device suitable for plating minute portions on projections at forked ends of a connector terminal.

BACKGROUND OF THE INVENTION

Connector terminals are formed in plurality in the form of comb teeth arranged on a continuous band-like member having pilot holes and respectively provided with a pair of projections each having a minute area (e.g. 1 $mm^2$ or less) at the end thereof which has to be plated. Various techniques have conventionally been employed for plating these minute portions. For instance, there have been known as typical plating devices such as the plating device which dips the whole end portion including the projections in the plating solution contained in a bath to conduct plating by controlling the liquid level to limit plating areas, or the injection plating device which shields the portions not to be plated with a mask and plates unmasked portions by jetting the plating solution on them (refer to Japanese patent application laid-open Nos. Sho 59-126784, Sho 57-161084, and Sho 55-83180).

All of the prior art plating devices have drawbacks, however. In the case of the former device, as the whole ends of a connector terminal including the projections which are the subject of plating are plated because a minute plating area is difficult to clearly define, the consumption of plating metal unavoidably increases. This presents a formidable problem when the plating metal is a precious metal such as gold. In the latter case, masking is extremely difficult especially when the subject area is not even but irregular, bent, or complicated. The plating area is not clearly defined by the device to thereby incapacitate sufficient reduction of metal consumption.

The present inventors proposed an improvement for brush plating method (Japanese patent application No. Sho 60-89016) wherein the surface of an insoluble anode is covered with a liquid retaining member which can constantly be supplied with plating solution, the plating device is configured to be in alignment with the interval between adjacent fork-like ends of a connector terminal so that the tip end portions of the connector terminal may be plated while moving in contact with the member retaining the plating solution. As the proposed technique is effective in plating only the portions of the connector terminal ends which actually contact with the member on the anode surface, it may be called a minute partial plating method as compared with the prior art methods which allow only partial plating, achieving a remarkable reduction in precious metal consumption and precise definition of plating area.

However, the amount of plating solution applied on the plating area and the scope (area) of the plating tend to be influenced by such factors of the solution retaining members as the material or conditions or retainability since the plating solution is supplied to the member directly when the member is dipped in or out of the solution. It has long been desired to have a plating device suitable for plating minute portions which is capable of specifying the plating areas precisely without being influenced by conditions of the retaining member, of maintaining such precisely specified areas for a long time, and of continuous plating.

BRIEF SUMMARY OF THE INVENTION

An object of this invention is to provide a plating device suitable for plating minute portions of a connector terminal which can satisfy above mentioned requisites.

The above and other related objects and advantages will be understood more clearly by referring to the description and claims based upon the attached drawings.

DESCRIPTION OF THE PREFERRED EMBODIMENTS

Figure 1:
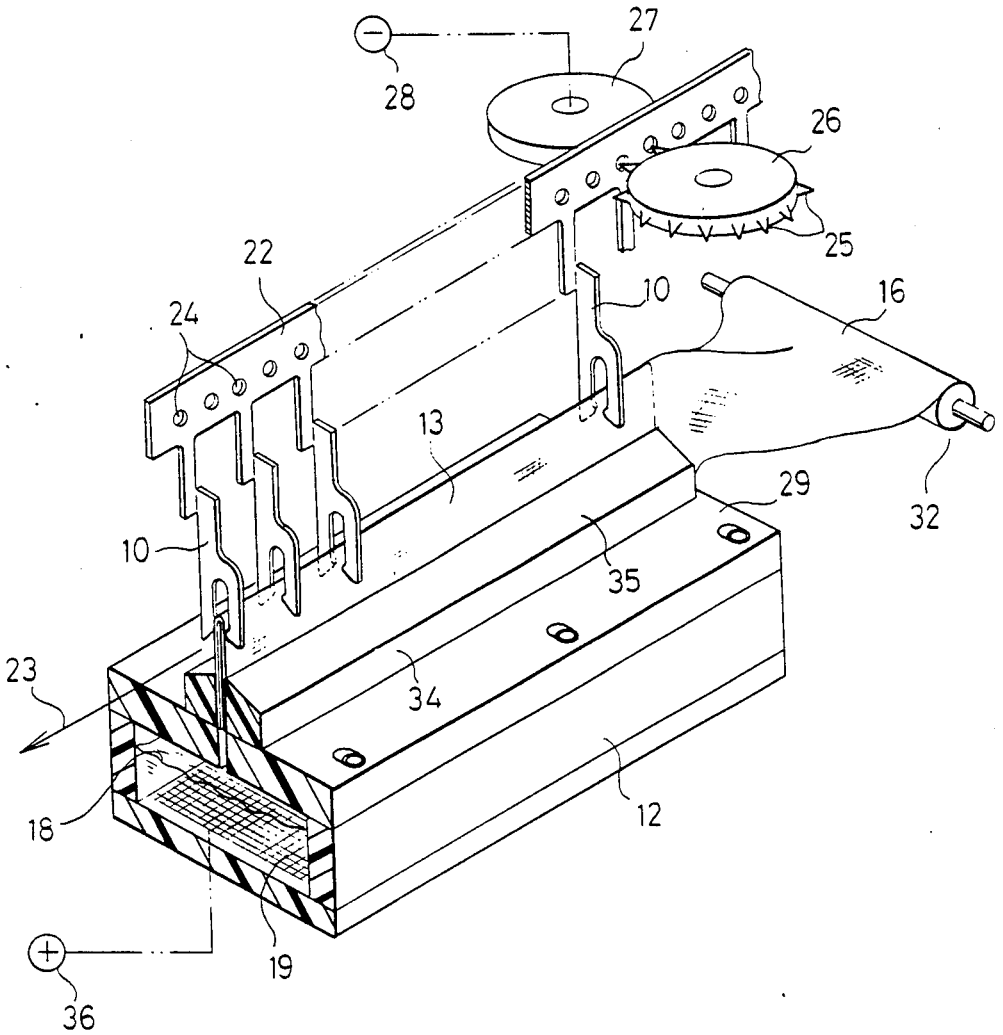
FIG. 1 is a schematic perspective view to show the first embodiment as a whole of the plating device suitable for plating minute portions of a connector terminal.

This invention will now be described by way of preferred embodiments. The same reference numerals and symbols denote the same components in the embodiments, and overlapping description is omitted.

The first embodiment

Figure 2:
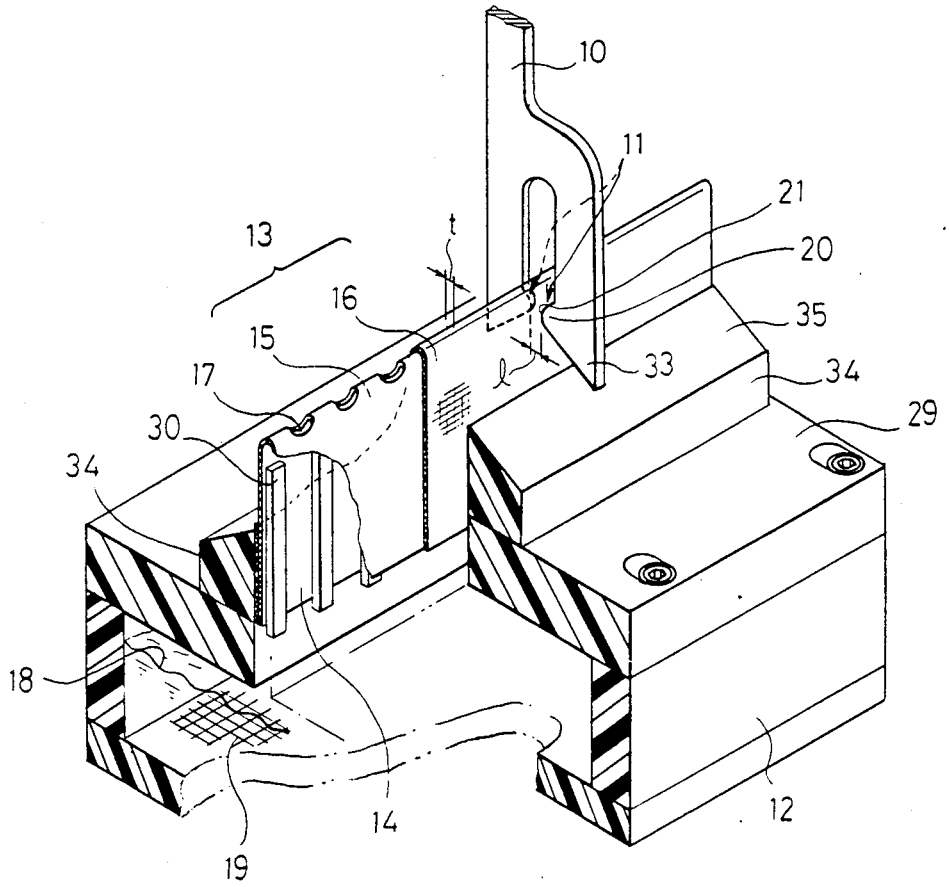
FIG. 2 is an enlarged perspective view of the essential portions of the plating device in FIG. 1.
Figure 3:
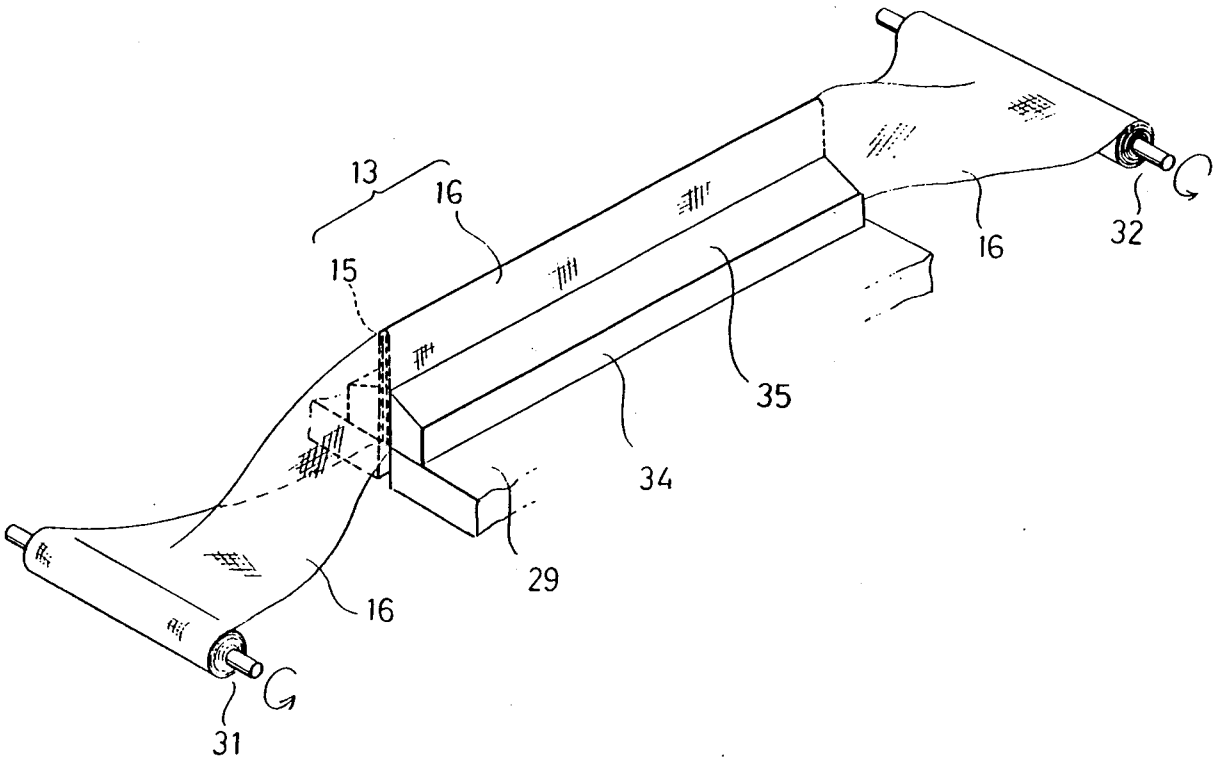
FIG. 3 is a perspective view to show winding state of a plating solution retaining member in essence.

Referring to FIGS. 1 through 3, the first embodiment will be described.

Connector terminals 10 which are the subject of plating are formed in plurality in the form of comb-teeth on the lower portion of a continuous band-like member 22 and are respectively provided with fork-like ends extending in the direction perpendicular to the longitudinal direction of the band-like member 22. The areas which have to be plated 11 are a pair of tip surfaces of the forked ends which are opposed to but spaced apart from each other with an interval which converges at the middle and then again diverges to define a substantial triangle therebetween. Those two areas 11 are concurrently plated as a pair, but for the sake of simplicity of description, one of the areas or the right side portion alone will be denoted with the reference numeral 11 hereinafter, and when explanation is needed for the both, the reference numerals are repeated like plating areas 11,11.

The plating area 11 is adapted to move along a passage line 23 by a combination of a sprocket 26 and a roller 27 which is pressed against the sprocket 26. The sprocket 26 has pins 25 provided on the circumference thereof to freely fit in pilot holes 24 of a continuous band-like member 22. The roller 27 is connected to a cathode power source 28 to cathodize the connector terminals 10.

A plating solution supplying member 13 is arranged along the passage line 23 and comprises a combination of a supporting member 15 and a plating solution retaining member 16 which is erected on a plating solution box 12 with a supporting plate 29. The member 13 has a rectangular shape of a small thickness.

The supporting member 15 made of an insulating sheet is thin and yet strong enough as a core to be able to support the plating solution retaining member 16. The member 15 is formed to have plating solution passage 14 of a minute width between adjacent teeth. The supporting member 15 has a vertical section shaped substantially like an inverted letter U to cover the passage 14 in order to reduce the platable area. The member 15 is preferably made of a sheet of Tetron (trademark) or of Mylar (trademark). Spacers 30 are provided inside the supporting member 15 in a space corresponding to the passage 14 for the plating solution to extend vertically in the form of tape. If a sheet of insulating material is folded into two to accommodate the thickness of a spacer 30, then narrow passage 14 is made for plating solution each between adjacent spacers 30. The spacers 30 act as rectifiers for the flow of the plating solution 18 inside the passage 14.

At the top of the folded member 15 are provided plural solution supplying holes 17 in the longitudinal direction as the "members corresponding to moving plating areas 11,11 on both sides".

The plating solution retaining member 16 is supported by the supporting member 15 to drape over the side surfaces thereof. In the embodiment shown in the figure, the member 16 is made of a polypropylene net, but it may be made of porous sheet similar to a net so long as it allows the plating solution 18 supplied thereto via the holes 17 to seep so that the optimal amount of the solution 18, neither more nor less than necessary, is supplied onto the plating area 11 which contacts therewith. The plating solution supplying member 13 comprising a solution retaining member 16 held over the supporting member 15 has an extremely narrow thickness (t) to correspond the distance (l) between two opposing plating areas 11,11 of the forked ends of a connector terminal 10 which is as small as 0.38 mm, for example. The passage 14 inside has similarly narrow width (for instance 0.1–0.2 mm). The thickness is determined so that the plating solution supplying member can be inserted between the opposing areas 11,11 to allow them to contact with the solution retaining member 16 near the top thereof.

As the plating areas 11,11 either contact or come very close to the solution retaining member 16 while moving along the passage line 23, the member 16 might be worn out after a long term use. The solution retaining member 16 is wound around winding devices 31,32 outside the supporting member 15 so that a new sheet of the member 16 constantly covers the surface of the supporting member 15 as one of the winding devices undoes the sheet while the other winds it.

The plating solution supplying member 13 is erected on a box 12 and a supporting plate 29 is used to assemble the supporting member 15 and the solution retaining member 16 draped thereon. The plate 29 is provided with a pair of holder/guides 34 which holds the retaining member 16 on the supporting member 15 from both sides and guides the lower portions 33 of the connector terminals 10 as it moves. The pressure against the member 16 applied by the pair of the holder/guides 34 is released when a new sheet is reeled out as mentioned above. The holder/guides 34 are sloped at the upper portion 35 so as to accommodate the same to the form of the lower portions 33 of the connector terminals 10 as well as to guide them while the connector terminals 10 move. However, the portions 33 do not necessarily contact with the upper portions 35 of the holder/guides 34 to be guided thereby.

Inside the box 12 which is closed with the supporting plate 29 is provided an anode 19 of platinum in the form of a net which is connected to an anode power source 36.

Description will now be given to the operation of the first embodiment of the plating device suitable for minute portions of a connector terminal. The connector terminal 10 is cathodized and guided via the sprocket 26 and the roller 27 to move in the direction from right upper side toward left lower side in FIG. 1, and the plating areas 11,11 move along the passage line 23 to contact with or come very close to the plating solution retaining member 16.

When the plating solution 18 inside the box 12 is pumped out by a pump (not shown), the solution 18 is forced to go up in narrow passages inside the passage 14 and between adjacent spacers 30, flow out to the outside of the supporting member 15 from the holes 17 near the top of the member 15, and seep into the pores or mesh of the solution retaining member 16.

When the plating areas 11,11 contact with or come close to the solution retaining member 16, the tips 20 of the triangles of areas 11,11 are positioned at or close to both sides of the top of the solution retaining member 16 to contact with the plating solution 18 freshly supplied from the holes 17. In this manner, an optimal amount of the plating solution 18, not more or not less than the necessary amount, is supplied substantially evenly on limited locations of the plating areas 11,11, more particularly the locations near the tips 20, and other locations 21 adjacent thereto.

In this manner, a minute portion of the respective plating areas including the tip 20 of and adjacent locations 21 of the protruding portion can be specifically plated in a substantially even thickness.

The embodiments 2 through 4 will now be described. As they have many components common to the first embodiment, the similar components are denoted by the same reference numerals but description is omitted.

The second embodiment

Figure 4:
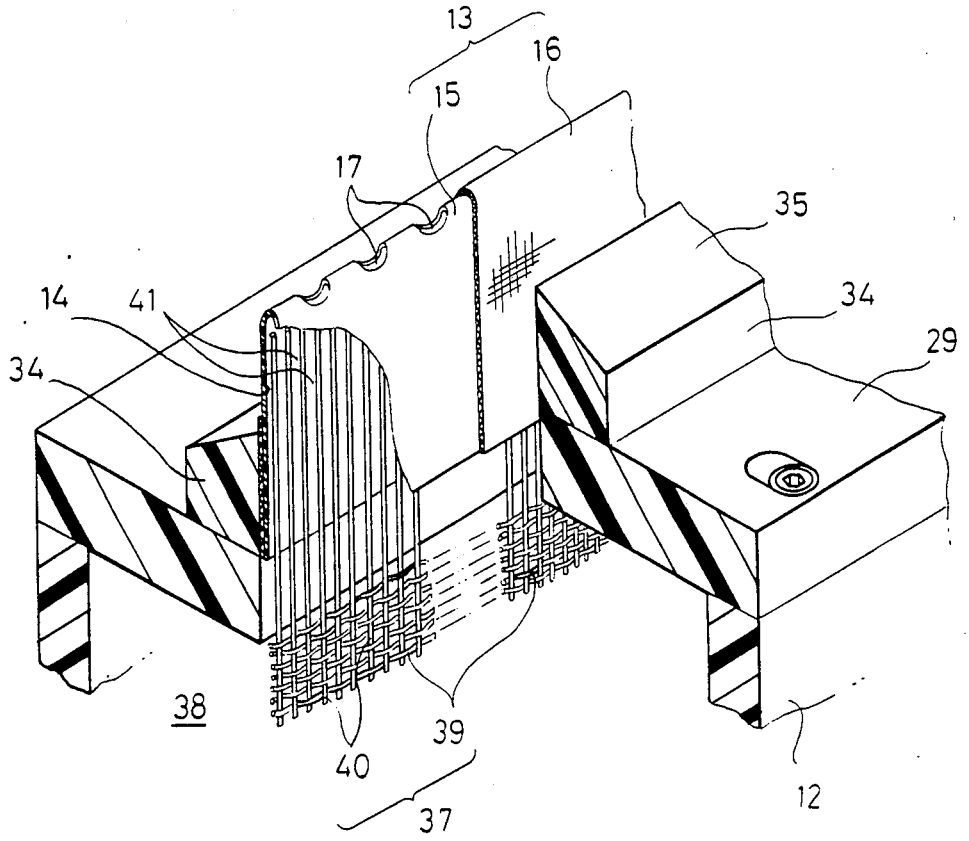
FIG. 4 is an enlarged perspective view to show the second embodiment which corresponds to FIG. 2.

Although in the first embodiment, a platinum anode 19 in a net form is provided with a box 12, in the embodiment 2 in FIG. 4, a platinum net member 37 is interposed as an anode in the solution passage 14 inside the supporting member 15.

The net member 37 is connected to an anode power source 36 and is positioned to extend from the inside space 38 of the box 12 to the solution passage 14. Wefts 39 and warps 40 are woven in the inside space 38, but warps 40 alone are erected at a small interval in the solution passage 14 to minimize the thickness of the anode. When pressure is applied on the solution 18 in the space 38, the solution is forced to go up through narrow passages 41 between the solution passage 14 and between the respective warps 40, and to seep onto the surface of the solution retaining member 16 from the holes 17.

The plural warps 40 extend to the holes 17 at the top thereof respectively so that the distance between the "anode" and the plating area 11 is kept extremely short. They therefore can have the function of the spacers 30 of the first embodiment, i.e. the function to rectify the flow of the plating solution 18 and minimize the width of the passage 14 when the said passage 14 is formed by folding the insulating sheet into an inverted U letter.

The third embodiment

Figure 5:
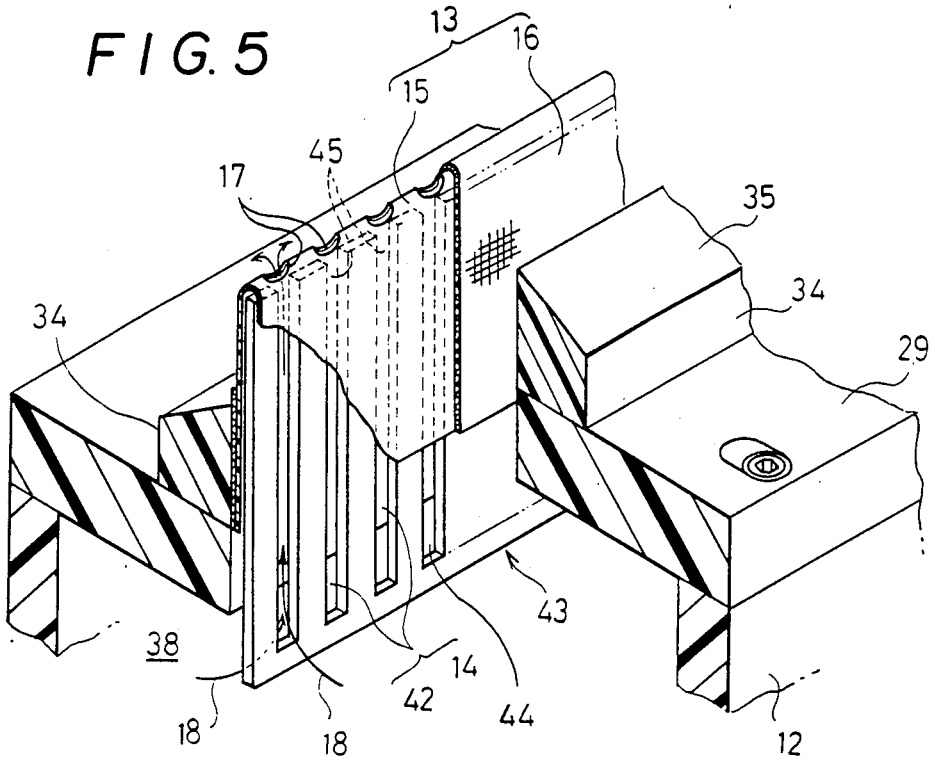
FIG. 5 is an enlarged perspective view to show the third embodiment which corresponds to FIG. 2.
Figure 6:
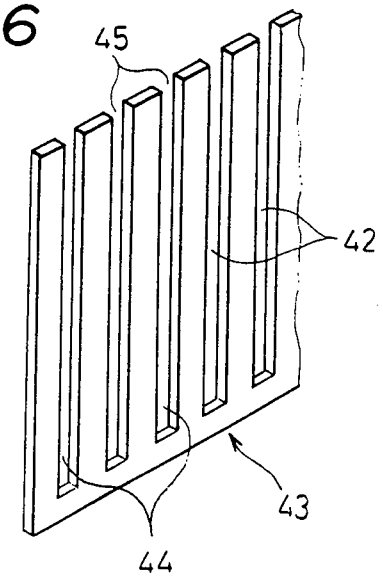
FIG. 6 is a partial perspective view to show a thin plate (anode) shown in FIG. 5; and, FIG. 7 is a cross sectional view to show the fourth embodiment in essential parts.

FIGS. 5 and 6 show the third embodiment. While the first and second embodiments use a net member 37 as an "anode", a thin plate 43 having vertical slit-like passages 42 in a plural number is employed as an "anode". The thin plate 43 is inserted into the supporting member 15 which is folded like a letter U. When held tightly between the both sides of the member 15, the lower portions 44 of the passages 42 communicate with the inside space 38 of the box 12 while the upper portions 45 communicate with the holes 17. The width of the passages 42 is designed to be an extremely small value so as to facilitate the upward flow of the solution 18 from the inside space 38 to the holes 17. The thin plate 43 has the same function as the spacers 30.

The fourth embodiment

Figure 7:
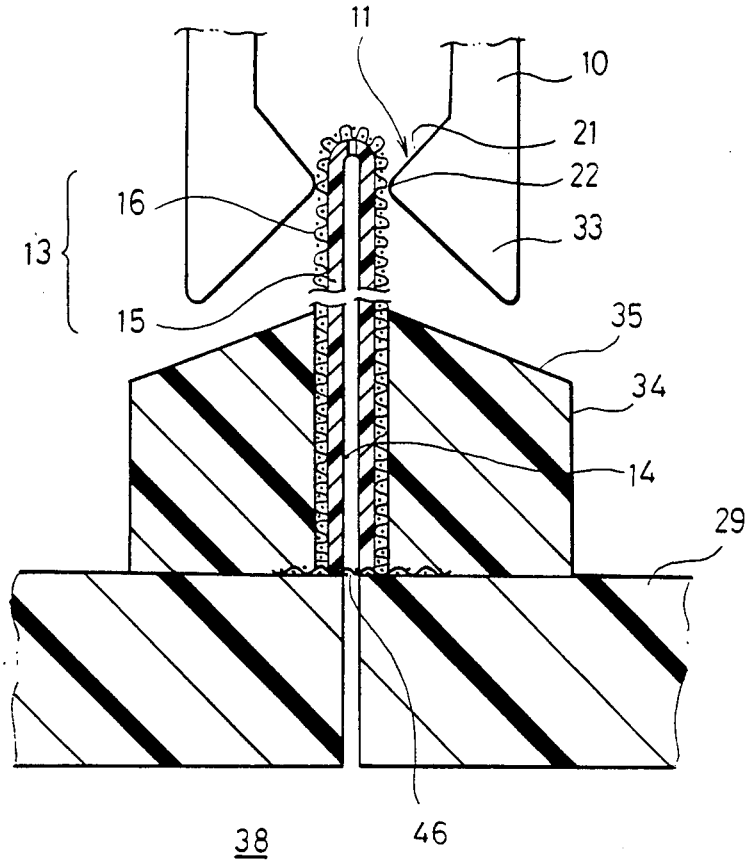

FIG. 7 shows the fourth embodiment. While the position of an "anode" in the first embodiment is inside the box 12, and in the passage 14 in the second and third embodiments, a platinum net member 46 is arranged near an inlet of the passage 14 as an "anode" in the fourth embodiment.

The plating device suitable for plating minute portions of connector terminals according to this invention can achieve various effects such as:

(A) As the plating solution supplying member 13 comprises a combination of a supporting member 15 made of an insulating sheet and a solution retaining member 16 made of a meshed or porous sheet, the thickness can be easily minimized in manufacturing process to the extent that allows insertion of the supplying member 13 between a pair of plating areas 11 of a connector terminal 10 which oppose each other across an extremely narrow distance.

(B) As a solution retaining member 16 is used to supply the plating solution to a pair of plating areas 11 which contact with or come close thereto, the plating solution conveniently seeps out from the member 16 after it is fed via holes, and the amount of the plating solution to be supplied onto the plating areas can be controlled at the optimal value.

(C) As the plating solution is applied only to the locations to be plated, and these locations alone are electro-plated, even minute portions can be specifically plated.

(D) As the plating solution can be forced to pass through passages of minute width which are provided all over the inside of the supporting member 15 to contact with the anode disposed either inside the passage, at the inlet of the passage or inside the box and to seep out from the holes via the retaining member, the plating solution can be constantly supplied for continuous plating process.

(E) Due to the synergistic effects of the above four, this invention device can effectively electroplate minute portions of a pair of plating areas of a connector terminal.

What is claimed is:

1. In a plating device suitable for plating minute portions of connector terminals which are formed in a comb teeth-like fashion on a continuous band-like member and each of which has a pair of protruding minute plating areas at the tip ends thereof, comprising: a plating solution supplying member adapted to be inserted between the pair of plating areas of each connector terminal and extending in the direction in which said connector terminals move so that said plating areas of each connector terminal can be electro-plated while they are moving in said direction by either contacting the plating solution supplying member or passing very close thereto, said plating solution supplying member comprising a supporting member made of an electrical insulating sheet which in cross-section is shaped substantially like an inverted letter U and which forms an extremely narrow passage for plating solution between the opposing sides thereof, and a plating solution retaining member made of a mesh or porous sheet and which is supported by said supporting member and which is draped over the outer surface of said supporting member, the thickness of said plating solution supplying member being made small enough so that it can be inserted between said plating areas, the combination of said supporting member and said plating solution retaining member being erected upon a plating solution box in the form of a thin elongated blade, said supporting member being provided with plural, discrete, longitudinally spaced-apart plating solution supplying holes 17 arranged in the longitudinal direction at positions corresponding to the plating areas or close thereto, and an anode positioned for contacting said plating solution.

2. The plating device as claimed in claim 1 wherein said supporting member is provided with plural tape-like spacers disposed inside said narrow passage for the plating solution, the width of said passage being determined in accordance with the thickness of said spacers, and each spacer functions as a rectifier for the flow of the plating solution inside said passage.

3. The plating device as claimed in claim 1 or claim 2 wherein said plating solution supplying member comprising said supporting member and said plating solution retaining member which covers the outer surface of said supporting member has a thickness small enough to be interposed between a pair of protruding plating areas which extend from a connector terminal and which are opposed to each other across an extremely small distance.

4. The plating device as claimed in claim 1 wherein said plating solution retaining member is wound around winding devices at positions outside said supporting member, so that the surfaces of said supporting member can be covered constantly with a new portion of said plating solution retaining member which is reeled out from one of said winding devices and reeled in by the other.

5. The plating device as claimed in claim 1 wherein said plating solution supplying member is held tightly on its opposite sides by a pair of holders, the top portion of said holders having shapes corresponding to the shape of the lower portions of a connector terminal so that the lower portions of the connector terminal can be guided by said top portions while moving in said direction of movement.

6. The plating device as claimed in claim 1 wherein said anode is a net member made of platinum which is positioned inside said box.

7. The plating device as claimed in claim 1 wherein said anode 37 is a net member made of platinum which extends from said inside of the box to the inside of said passage 8. The plating device as claimed in claim 7 wherein said anode comprises woven warp and weft threads, but in which only warp threads are erected at small spacings without weft threads at the portion inside said passage to facilitate flow of the plating solution upwardly through narrow passageways between adjacent warp threads inside said passage.

9. The plating device as claimed in claim 8 wherein said anode is disposed inside said passage for said plating solution and is effective to rectify the flow of the plating solution therethrough and to minimize the width of said passage.

10. The plating device as claimed in claim 1 wherein said anode is formed as a thin plate having plural vertical slit-like passageways and extending from the inside of said box to the inside of said passage and the slit-like passageways communicate with the inside of the box at the lower portions thereof and with the inside of said holes at the upper portions thereof.

11. The plating device as claimed in claim 10 wherein said anode is positioned inside said plating solution passage and is effective to rectify the flow of the plating solution and to minimize the width of the passage.

* * * * *